United States Patent [19]

Cotton

[11] 3,960,240

[45] June 1, 1976

[54] TREE CLIMBING DEVICE

[76] Inventor: C. W. Cotton, Rte. No. 11, Central Church Road, Douglasville, Ga. 30134

[22] Filed: Sept. 16, 1974

[21] Appl. No.: 506,034

[52] U.S. Cl. ..... 182/20; 182/187

[51] Int. Cl.[2] ..... A63B 27/00; E04G 3/10

[58] Field of Search ..... 182/187, 20, 82; 248/236, 216, 226 R, 246

[56] References Cited

UNITED STATES PATENTS

| | | | |
|---|---|---|---|
| 3,289,787 | 12/1966 | McSwain | 182/20 |
| 3,352,379 | 11/1967 | Riggs | 182/20 |
| 3,460,649 | 8/1969 | Baker | 182/187 |
| 3,485,320 | 12/1969 | Jones | 182/187 |

*Primary Examiner*—Reinaldo P. Machado
*Attorney, Agent, or Firm*—Patrick F. Henry

[57] ABSTRACT

A pair of projecting platforms attached around a tree trunk one above the other are moved up a tree by a person sitting on the uppermost platform and reaching below and pulling the lowermost platform up close to the botton of the uppermost platform and then while standing on the lowermost platform rising from the seat of the uppermost platform and lifting it upwardly behind and then repeating the procedure until the desired height is reached. The uppermost and lowermost platforms both have adjustable tree-engaging frames which are placed around the tree trunk.

6 Claims, 5 Drawing Figures

TREE CLIMBING DEVICE

BACKGROUND OF THE INVENTION

1. Field of the Invention

Portable tree platforms, tree climbing devices and portable seats. Class 182, Subclasses 133, 135, 187 and 221 may be involved.

2. Description of the Prior Art

Portable platforms and seats for use on a tree or pole are well known and are, for example, disclosed in U.S. Pat. Nos. 3,338,322; 3,340,828; 3,513,940; 3,065,821; 2,991,842; 3,358,798; 1,187,078 and 1,206,574, as well as other patents. Some of these devices are simply seats which are attached about the tree trunk or pole by means of a chain, belt, strap or other means and either near ground level or as high as one can reach. In other devices a ladder or an attachment for the tree or pole is used for the purpose of getting up the tree to put the device in place. Such seats or platforms are commonly used by hunters, bird watchers and other people who wish to take a temporary position in a tree or on a pole and which is more comfortable than simply sitting on a branch or the like. The basic problem with such devices that are to be elevated on the tree is getting it up the tree or pole, securing it in place after the position is reached and getting back down again. Futhermore, there is no real serious danger as long as the device is not very high above the ground, but once the person intends to use it at a fairly high elevation it becomes extremely dangerous if not secured properly to the tree or pole during ascent and descent. The platforms disclosed in U.S. Pat. Nos. 3,460,649 and 3,485,320 are intended to be placed about the tree trunk while standing on the ground and then worked up the tree by standing and facing the tree and then while standing on the lower platform facing the tree bending the body so as to work the platform up the tree. In the Baker U.S. Pat. No. 3,460,649 device the person operating the device must hug the tree trunk to hold on securely and use arm and chest strength while bending the legs and working the device up the tree. People have been known to slip and fall both while working their way up the tree or while attempting to work the device back down the tree. This is because at certain times such devices are completely detached from the tree and the person is held only by hugging the tree trunk. The Jones device U.S. Pat. No. 3,485,320 depends upon jumping up and down on the platform through the use of a resilient connection between the lower and upper platform without the security of hugging the tree and while facing and relying upon the engagement of the tree as well as requiring a certain amount of effort and energy to try and work the device up the tree trunk. The present device is easy and safe to operate and the person is always secure alternating between sitting and partial standing.

SUMMARY OF THE INVENTION

An object of the present invention is to provide a tree ascending device which is composed of a pair of spaced platforms alternately moved by sitting on the top platform which is in firm engagement with the tree and lifting the bottom one and then standing on the bottom which is in firm engagement with the tree and lifting the top one.

A further object of this invention is found in the safety arrangement of the device whereby the weight of the person moving the platform is either on one or the other of the two platforms thereby keeping at least one platform in firm engagement with the tree or pole.

Another advantage of the present invention resides in the safety and ease of operation of the device whereby the person may take his time moving the device up the tree and may rest as desired while sitting on the uppermost platform and during the time that the person is moving one platform or the other up the tree.

Another object of the present invention is to provide an arrangement whereby the platforms may be moved up the tree while the person is seated facing outwardly from the tree which is the position normally used for hunting or bird watching and the like.

Another advantage of the present invention resides in the security of the device of both the upper and lower platform since a good bit of weight is pulling the tree engaging knife into position against the tree to hold it in place.

An additional advantage is in being able to step on the bottom platform should the top platform start to move.

Other and further objects and advantages of this invention will become apparent upon reading the following specification taken in conjunction with the accompanying drawings.

DESCRIPTION OF A PREFERRED EMBODIMENT

Figures 1, 2, 3, 4, 5:
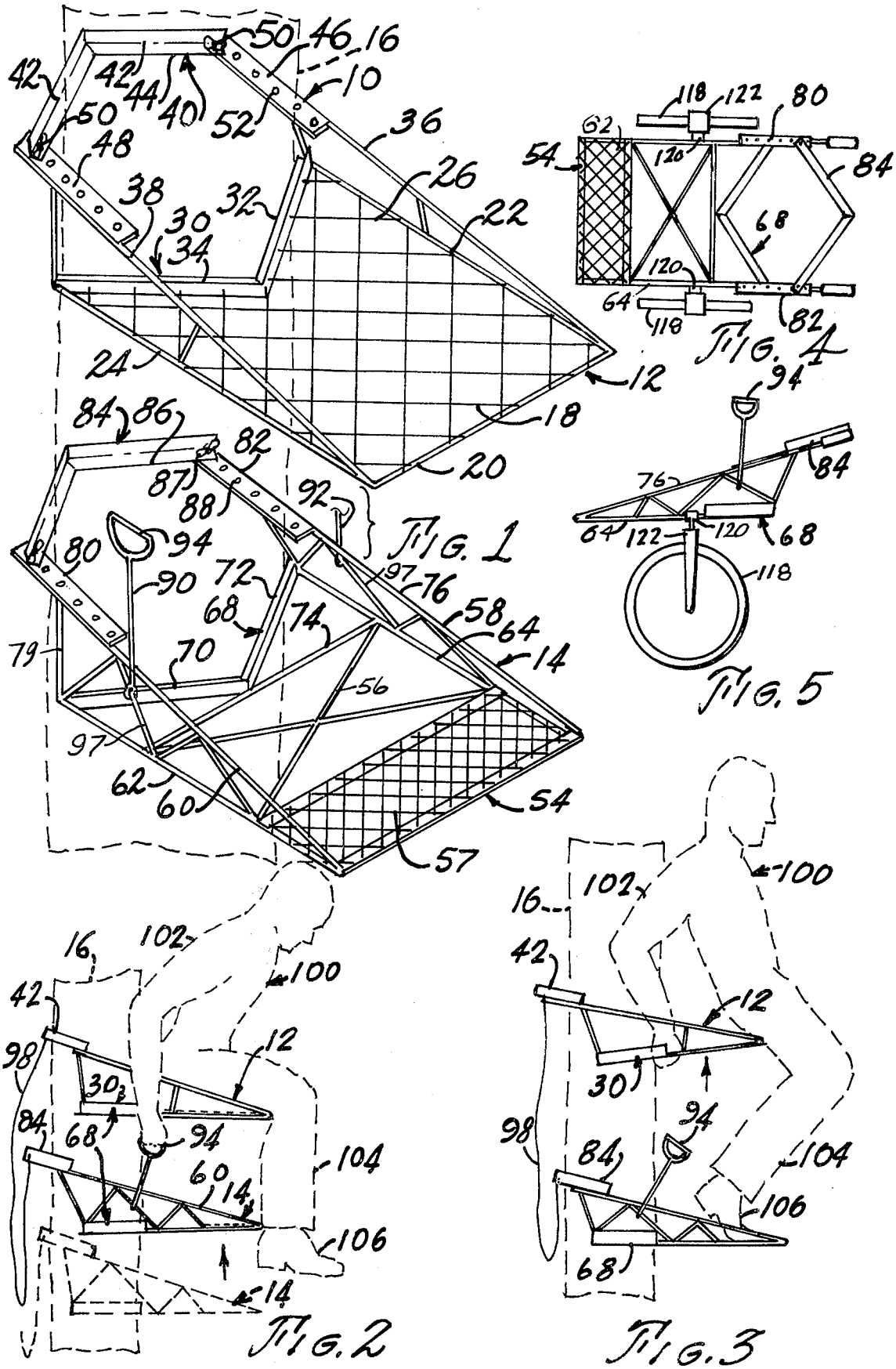
FIG. 1 is a perspective view of the present device in position on a typical tree trunk shown by dotted lines.
FIG. 2 is the first of two figures illustrating a typical method of moving the device up a tree.
FIG. 3 is the second of the two figures illustrating the movement of the device up a tree.
FIG. 4 is a top plan reduced view of the present device with a removable set of wheels thereon.
FIG. 5 is a side elevation view of the arrangement shown in FIG. 4.

The complete device which is designated generally by reference numeral 10 comprises a pair of separate but cooperative platform devices designated generally as 12 and 14 and each of which is a platform frame positionable about a tree trunk 16, pole or other similar device. Of course, it is necessary that the tree 16 or pole be substantially free of any major obstruction such as large limbs or that such obstructions be removed ahead of the climber. Many pine trees are already substantially bare for quite a distance from the ground up the trunk. Frame 12 comprises a two-dimensional top platform 18 constructed from metal rods arranged in substantially rectangular formation and there being a front member 20, side members 22, 24 and a metal grid 26 made up of intersecting metal rods providing an open platform seat. The rear of the platform 18 is provided with an angular V-shaped tree engaging means knife bar 30 which comprises a pair of angular steel members 32, 34 forming a V-shape having knife edges on the inside. Side trusses 36, 38 constructed from metal rod, extend upwardly from platform 18 and have a rear tree engaging frame 40 attached thereto. Frame 40 comprises an angular V-shaped knife bar 42 with sharp inner knife edge 44 which engages the tree 16 trunk. Knife bar 42 has the ends thereof adjustably mounted on a pair of projecting plates 46, 48 attached to the side trusses 36, 38 and the knife bar 42 is held in place at the ends by removable screws 50 fitting in one of several sets of holes 52 on the members 46, 48 to adjust to different size trees.

The lower platform 14 is usually engaged by the feet of an occupant in the manner shown in FIGS. 2 and 3. Platform 14 comprises a rectangular frame 54 having intersecting, crossed metal rod members 56 thereon providing a bottom platform 57 attached to a pair of upstanding side trusses 58, 60 constructed from metal rod. A pair of elongated bottom rod members 62, 64 in the respective trusses 58, 60 are attached to an angular V-shaped tree engaging knife bar means 68 comprising a pair of members 70, 72 and having the ends thereof attached to the side members 62, 64 and the apex thereof attached to a cross member 74 extending between said side members 62, 64. Inclined side frame members 76, 78 in each truss 58, 60 are attached to respective bottom rod members 62, 64 by various short truss members 79 and extend beyond the end of the bottom frame and connect to respective metal plates 80, 82 thereon to which is attached a V-shaped tree engaging knife bar 84 having a knife edge 86 on the inside thereof. Knife bar member 84 is selectively attached in place by bolts 87 in a selected pair of holes 88 on the respective plates 80, 82. A pair of lifting rod members 90, 92 each having a handle 94, 96 thereon and each is attached to a diagonal member 97 on respective side frame members 76, 78 to be pulled by hand in the manner shown in FIG. 2. There is also a small lightweight nylon line or cable 98 attaching the upper platform 12 with the lower platform 14 so that there would be no danger of a complete separation of the lower platform 14 if for any reason it should become completely detached.

As shown in FIG. 2, the occupant person 100 has arms 102, legs 104 and feet 106 and sits on the upper platform 12 after having initially positioned the two platforms 12, 14 as high on the tree as possible while standing on the ground. The occupant 100, as seen in FIG. 2, while sitting on the upper platform device 12 reaches below, grasps and pulls on the handles 94 disengaging the blade 86 from the trunk and then pulls platform device 14 to a position close to the bottom of the top platform 12. Next, as shown in FIG. 3, the occupant 100 stands on the bottom platform 57 with the feet 106 and arches forward to remove the weight from the upper platform 12 just long enough to reach behind and grasp the platform 12 by the sides thereof and to lift same as far upwardly behind the back as the occupant is capable of doing depending upon the ability to arch forward and to move out of the way. Then the procedure is repeated by again resuming the seated position of FIG. 2 and reaching below grasping the handles 94, 96 and lifting the lowermost platform device 14 and so on.

As seen in FIGS. 2 and 3, the knife bar 68 is below and in a different plane from the knife bar 84 so that the weight of the occupant 100 causes both to dig into the tree whereas without weight the pull on handle 94 through the rods 90, 92 easily detaches the knife bars 68, 84. Similarly, the weight on top platform 18 against knife bar 30 causes it to dig in and also knife bar 42 on the other side due to the difference in height and plane of the two knife bars 30, 42. Thus attachment is achieved simply by tilting.

In FIGS. 4 and 5, bottom platform 14 has removable 20″ bicycle wheels 118 attached to the side frames by means of adjustable clamps 120 attached to the forks 122 of each wheel 118. The other platform 12 can be placed on top of platform 14 together with various equipment such as camping gear, rifle, etc. piled on top and the whole vehicle wheeled to the tree location. A rifle may be inserted through the trusses 36, 38 and carried up the tree with the platform device 12.

While I have shown and described a particular embodiment of this invention for purpose of illustration, this is not the only form of the invention since various alterations, changes, deviations, eliminations, variations and departures may be made in the embodiment shown without avoiding the scope of the invention as defined only by interpretation of the appended claims.

What is claimed is:

1. In a tree climbing device:

a top platform having an occupant seat thereon which extends near the front outer edge of said platform and on which an occupant sits facing outwardly from the tree during part of the time that the tree climbing device is being raised to a higher level, a bottom platform mounted on the same side of the tree below said top platform and extending in the same direction in spaced relation thereto, each of said top and bottom platforms projecting substantially coextensively outwardly and each having tree engaging means thereon comprising a means on each side of said tree engageable with the tree by means of the weight of the person to retain said platform thereon, said tree engaging means on each platform being disengageable from the tree by tilting the projecting platform upwardly after relieving the weight thereon, grasping means on each side of said bottom platform for grasping by a person sitting on the top platform on the seat thereon with the person's knees extending around the outer edge of said seat and his feet adjacent the bottom platform thereby causing said platform to engage the tree and remain firmly in place while said person reaches below to the bottom platform and grasps the grasping means to lift the bottom platform and disengage said same from the tree and raise same to a position closer to the top platform, said top platform being raised by said person rising from the edge of said seat on said top platform by straightening the body from a substantially seated position to rise off the top platform seat and thereby relieve the amount of weight of the person on the top platform which is located behind the person between the person and the tree being climbed and then reaching behind to tilt said platform to release same from engagement with said tree and to raise same behind the person's back while the person continues to arch forward with his weight substantially placed upon the bottom platform thereby raising the top platform behind a person's back at a higher level than previously and thereafter again sitting on said seat on top platform to engage same with the tree and repeating the previous operation of raising the lower platform, first one and then the other until the desired height has been attained.

2. The device in claim 1 wherein said platforms each have an upper knife bar at the end and a lower knife bar space therebelow on the other side of the tree.

3. The device in claim 1: said grasping means comprising an elongated member extending upwardly on said lower platform and handle means thereon.

4. The device in claim 2, each of said upper knife bars being adjustable for different size trees.

5. The device in claim 1, wherein: each platform comprising side members and a surface therebetween.

6. The device in claim 1, wherein: there is a removable wheel on each side of said bottom platform.

* * * * *